United States Patent [19]

Kavieff et al.

[11] Patent Number: 5,058,508

[45] Date of Patent: Oct. 22, 1991

[54] CONVEYOR SYSTEM WITH CANTILEVER CARRIERS

[75] Inventors: Shelden M. Kavieff; Clarence A. Dehne, both of Farmington Hills, Mich.

[73] Assignee: Jervis B. Webb Company, Farmington Hills, Mich.

[21] Appl. No.: 619,660

[22] Filed: Nov. 28, 1990

Related U.S. Application Data

[63] Continuation of Ser. No. 377,189, Jul. 10, 1989, abandoned.

[51] Int. Cl.[5] ..... B61B 3/00

[52] U.S. Cl. ..... 105/149; 105/156; 104/89; 104/130

[58] Field of Search ..... 104/89, 91, 93, 132, 104/172.1, 172.4, 182, 174, 96, 98, 104, 105, 130, 27; 105/148, 149, 152, 153, 156

[56] References Cited

U.S. PATENT DOCUMENTS

| | | | |
|---|---|---|---|
| 1,679,068 | 7/1928 | Allen et al. | 104/139 |
| 3,690,268 | 9/1972 | Goldstein | 104/172.4 |
| 3,791,308 | 2/1974 | Hartz | 104/139 |
| 3,814,022 | 6/1974 | Smith | 104/89 |
| 4,919,055 | 4/1990 | Hora | 104/89 |
| 4,936,222 | 6/1990 | Murai | 104/89 |

FOREIGN PATENT DOCUMENTS

| | | | |
|---|---|---|---|
| 2589135 | 4/1987 | France | 105/148 |

*Primary Examiner*—Robert J. Oberleitner
*Assistant Examiner*—Mark T. Le
*Attorney, Agent, or Firm*—Joseph W. Farley

[57] ABSTRACT

A conveyor system including a conveyor track, carriers supported thereby, and carrier propelling elements associated with the conveyor track, wherein each carrier includes frame structure having an article supporting portion disposed to one side of the conveyor track and a stabilizing portion disposed to the opposite side thereof. An auxiliary track mounted in parallel, transversely spaced relation with the conveyor track on the opposite side thereof, is engageable by stabilizing wheels on the stabilizing portion of the carrier frame structure so that the article supporting portion thereof is adapted to form a cantilevered type support on which an article can be mounted and transported, spaced transversely from the conveyor track and propelling elements. An article processing station is separated from the conveyor track and propelling elements by a slotted barrier wall through which the article supporting portion of the carrier frame structure projects.

10 Claims, 5 Drawing Sheets

CONVEYOR SYSTEM WITH CANTILEVER CARRIERS

This is a continuation of copending application Ser. No. 07/377,189 filed on July 10, 1989, now abandoned.

SUMMARY OF THE INVENTION

This invention relates to improvements in conveyor systems of the type including a conveyor track, carriers supported thereby, and propelling means associated with the conveyor track for moving the carriers longitudinally along it.

For purposes of the invention, the conveyor track may comprise a power and free type track assembly consisting of a carrier track and a power track mounted adjacent thereto, the carrier track supporting trolleys to which the carrier structures are attached and the power track supporting trolleys connected to an endless driven chain equipped with longitudinally spaced pushers engageable with driving dogs on the carriers. Examples of such a power and free track assembly are contained in U.S. Pat. No. 4,408,540 showing the power track located vertically below the carrier track, and in U.S. Pat. No. 4,771,697 showing the power track located vertically above the carrier track. Alternatively, the conveyor track may comprise a conventional overhead monorail type track arrangement in which the carrier structures are attached directly to the trolleys connected to the endless driven chain, as shown in U.S. Pat. No. 2,792,927. Accordingly, the term "conveyor track" as used herein is intended to apply to either a power and free or a monorail type of conveyor track.

Each of the prior U.S. Patents referred to above also illustrate that the normal relation between the conveyor track an carrier structure is one in which an article supported by the carrier structure is substantially centered transversely of the conveyor track. Overhead conveyor systems having the carrier structures located below the conveyor track may consequently require the provision of drip pans under the conveyor track, as illustrated in Pat. No. 4,771,697, to protect articles supported on the carriers from contamination by lubricants and dirt falling from the moving conveyor elements. In such overhead conveyor systems generally, the carrier structures obstruct access to the articles supported thereby and impede the performance of processing operations on the articles. In all conveyor systems having the normal conveyor track-carrier structure relation described above, the conveyor track extends through any processing operation, thus exposing the moving conveyor elements to any processing condition that operation may require. For example, the conveyor elements may be exposed to corrosion from a phosphate process, to contamination from a spray cleaning or painting process, to high temperature from a drying oven, or to all of these adverse conditions in a single conveyor system.

In a conveyor system of the present invention, the carrier structures each have a cantilevered article supporting portion displaced to one side of the conveyor track and moving conveyor elements which support and propel the carriers, thereby separating the paths of travel of the articles and the conveyor elements into two parallel, transversely spaced paths. As a result, the articles being conveyed are not exposed to contamination from the conveyor elements, and are less obstructed by the carrier structures; also, the conveyor elements are protectable from the adverse effects of processing operations on the articles The invention provides a conveyor system including a conveyor track, carriers supported thereby, and propelling means associated with the conveyor track for moving the carrier in a longitudinal direction along the conveyor track, wherein each carrier includes frame structure extending transversely of the conveyor track, the frame structure having an article supporting portion disposed to one side of the conveyor track and having a stabilizing portion disposed to the opposite side thereof. Article carrying means is attached to the article supporting portion for mounting an article on the carrier in transversely spaced relation to the conveyor track and the propelling means. Means for stabilizing the carrier frame structure includes an auxiliary track located in transversely spaced relation with the conveyor track at the opposite side thereof, and wheel means mounted on the stabilizing portion of the frame structure for engagement with the auxiliary track.

Where the conveyor system has an overhead conveyor track and the carrier frame structure is supported below the overhead conveyor track suspended from load supporting trolleys thereon, the article supporting portion of the carrier frame structure is arranged so that the article carrying means is disposed to the one article carrying side of the conveyor track transversely outwardly and vertically downwardly relative thereto, and is adapted to support from below an article mounted on the article carrying means.

An article processing station provided in a conveyor system of the invention is located along the conveyor track at the article carrying side thereof, includes a longitudinally slotted barrier wall separating the conveyor track and propelling means from the processing operation, and the article supporting portion of the frame structure of each carrier is adapted to project through the slotted barrier wall so that an article mounted on the article carrying means is positionable within the processing station and is movable therethrough by the carrier in relative isolation from the conveyor track and propelling means. That isolation may be enhanced by the provision of sealing means along the slotted barrier wall.

In a system of the invention employing a power and free type track assembly including a carrier track having for each carrier a pair of longitudinally spaced carrier trolleys to which the carrier frame structure is connected for articulation on correspondingly spaced vertical axes and a correspondingly spaced pair of stabilizing wheels engaging the auxiliary track for stabilizing the carrier frame structure, the carrier track may include a main track, a branch track, and a junction between the main and branch carrier tracks. The auxiliary track then includes a main auxiliary track extending parallel to the main carrier track, and a branch auxiliary track connected to the main auxiliary track adjacent to the junction, the branch auxiliary track extending parallel to the branch carrier track. One of the main and branch auxiliary tracks crosses one of the main and branch carrier tracks and has at the crossing spaced apart ends defining a gap, the length of which is less than the longitudinal spacing between the pair of stabilizing wheels. The crossing auxiliary track and the carrier track crossed thereby are relatively positioned vertically so as to provide vertical clearance between the stabilizing wheels and the crossed carrier track, and the carrier frame structure is connected to the pair of carrier trolleys in vertically spaced relation with the auxiliary tracks. Hence, the carrier can be propelled between the main and branch carrier track without interference with the crossed auxiliary track, and is stabilized by one of the pair of stabilizing wheels when the other wheel passes through the gap therein.

The foregoing and other features of the invention will further appear from the description to follow of the embodiment illustrated in the accompanying drawings.

DETAILED DESCRIPTION

Figure 1:
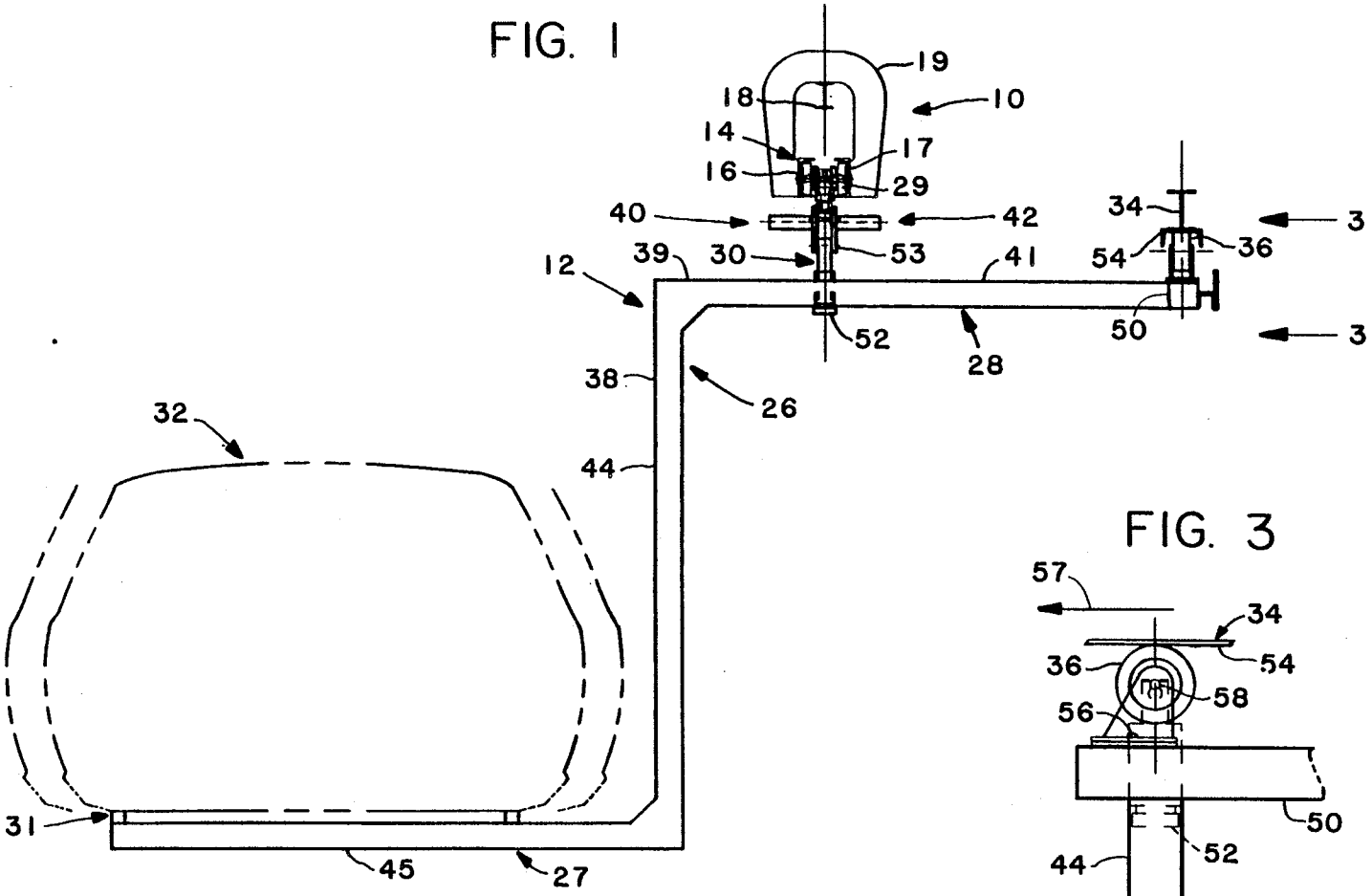
FIG. 1 is a transverse elevation of a conveyor system and carrier of the invention.
Figure 2:
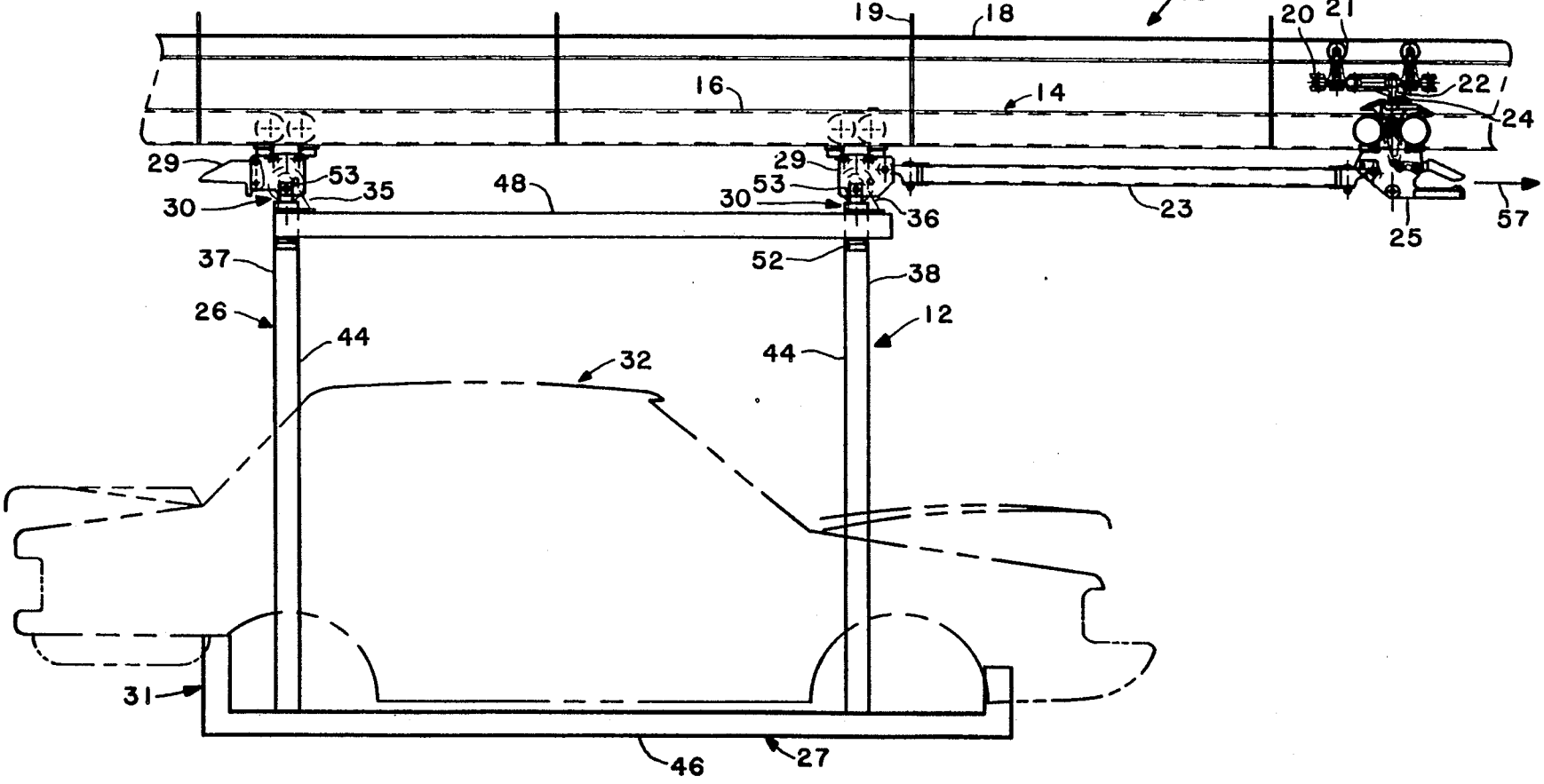
FIG. 2 is a side elevation of the conveyor system of FIG. 1.

The portion of a conveyor system of the invention shown in FIGS. 1 and 2 includes a conveyor track 10 and a carrier 12 supported thereby. As illustrated, the conveyor track 10 is a conventional overhead power and free type track assembly consisting of a carrier track 14 formed by a pair of transversely spaced channel-section track members 16 and 17 (FIG. 1) mounted below an I-section power track member 18 by longitudinally spaced track yokes 19. An endless driven chain 20 attached to trolleys 21 on the power track 18 and provided with pushers 22, constitutes a propelling means for moving the carriers 12 along the conveyor track 10, a pusher 22 being engageable with a driving dog 24 on a carrier driving trolley 25, as shown in FIG. 2. This power and free type of track assembly, while advantageous for a conveyor system in which carriers are to be stopped, or switched between main and branch tracks, is otherwise not essential in the practice of the invention.

As shown in FIG. 1, the carrier 12 in general includes frame structure 26 having an article supporting portion 27 disposed to one side of the conveyor track 10, and having a stabilizing portion 28 disposed to the opposite side thereof. This frame structure 26 is suspended below the overhead conveyor track 10 from load carrying trolleys 29 thereon by suitable suspension means 30, further described below, the leading load carrying trolley being connected to the driving trolley 25 by a tow bar 23. Article carrying means 31 suitable for the particular article to be transported on the carrier is attached to the article supporting portion 27 for mounting an article 32 thereon in transversely spaced relation to the conveyor track 10. Means for stabilizing the carrier frame structure is formed by an auxiliary track 34 extending parallel to and in transversely spaced relation with the conveyor track 10 on the opposite side thereof, the auxiliary track 34 being engageable by stabilizing wheel means 36 mounted on the stabilizing portion 28. For the overhead type of conveyor system illustrated, the article supporting portion 27 of the frame structure 26 is advantageously arranged so that the article carrying means 31 is disposed transversely outwardly and vertically downwardly relative to the conveyor track 10 and is adapted, through the engagement of the auxiliary track 34 by the stabilizing wheel means 36, to form a cantilevered support which extends below the article 32 mounted on the article carrying means 31. As a result, no part of the article 32 is positioned under the conveyor track 10 and thus exposed to contamination from the moving trolley and chain components associated with the conveyor track 10; and, no part of the article 32 is positioned under and thus obstructed by the frame structure of the carrier 12.

To describe the construction of the carrier 12 in more detail, the frame structure 26 is formed by a pair of frame members 37 and 38 spaced apart longitudinally of the conveyor track 10 and extending transversely thereof. Each of the frame members 37 and 38 has an upper section 39 which projects laterally relative to one, article supporting side 40 of the conveyor track 10, and which has a stabilizing extension 41 projecting laterally relative to the opposite, stabilizing side 42 of the conveyor track 10. A vertical section 44 extends downwardly from the upper section 39 and a lower section 45 projects laterally to the article supporting side 40 of the track from the bottom end of the vertical section 44. Longitudinally extending frame members 46 connect the lower sections 45 of the frame members 37 and 38 to form the article supporting portion 27 to which is attached the article supporting means 31, schematically shown since this means must be designed to suit the size and configuration of the particular article involved. Longitudinal connection of the frame members 37 and 38 is also provided by a track-centered lonitudinal frame member 48, and by a stabilizing portion lonitudinal frame member 50 connecting the extremities of the stabilizing extensions 41. The resulting frame structure 26 is relatively rigid both transversely and longitudinally.

As shown in FIG. 2, the pair of load carrying trolleys 29 of the carrier 12 are mounted on the carrier track 14 of the conveyor track 10 at a longitudinal spacing corresponding to the longitudinal spacing between the pair of transverse frame members 37 and 38. The suspension means 30 forms a pair of connections between the trolleys 29 and the frame members 38 with each connection including a vertical pivot 52 and a horizontal pivot 53 thus providing relative articulation between the carrier frame structure 26 and the trolleys 29 on a pair of vertical axes and a pair of horizontal axes in order to enable the carrier 12 to traverse any horizontal and vertical curves that may be required in the conveyor track 10. The axes of the vertical pivots 52 are spaced longitudinally a distance corresponding to the longitudinal spacing between the pair of trolleys 29, and the axis of each vertical pivot 52 is preferably intersected by the axis of the associated horizontal pivot 53.

Figure 3:
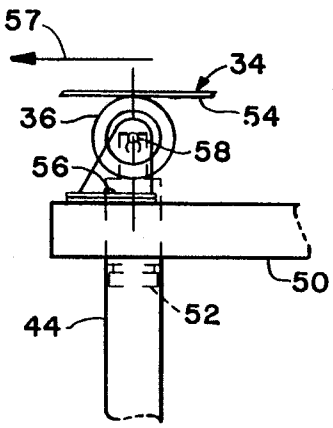
FIG. 3 is a side elevational detail, taken as indicated by the arrows 3—3 of FIG. 1, showing one of the auxiliary carrier stabilizing wheels.

The auxiliary track 34 is provided with a downwardly facing track surface 54 (FIG. 1) engaged by a pair of stabilizing wheels 35 and 36, mounted on the stabilizing portion 28 of the carrier frame structure 26 at a longitudinal spacing corresponding to the longitudinal spacing between the pair of trolleys 29 (FIG. 2). Each of the stabilizing wheels 35 and 36 is a caster wheel, as shown in FIG. 3, having a vertical swiveling axis 56 located in advance, with respect to the direction of carrier movement indicated by the arrow 57, of the location of the rotational axis 58 of the caster wheel and of its engagement with the track surface 54. That location of engagement is substantially aligned transversely with the axis of one of the vertical suspension pivots 52, as illustrated in FIG. 2.

Figure 4:
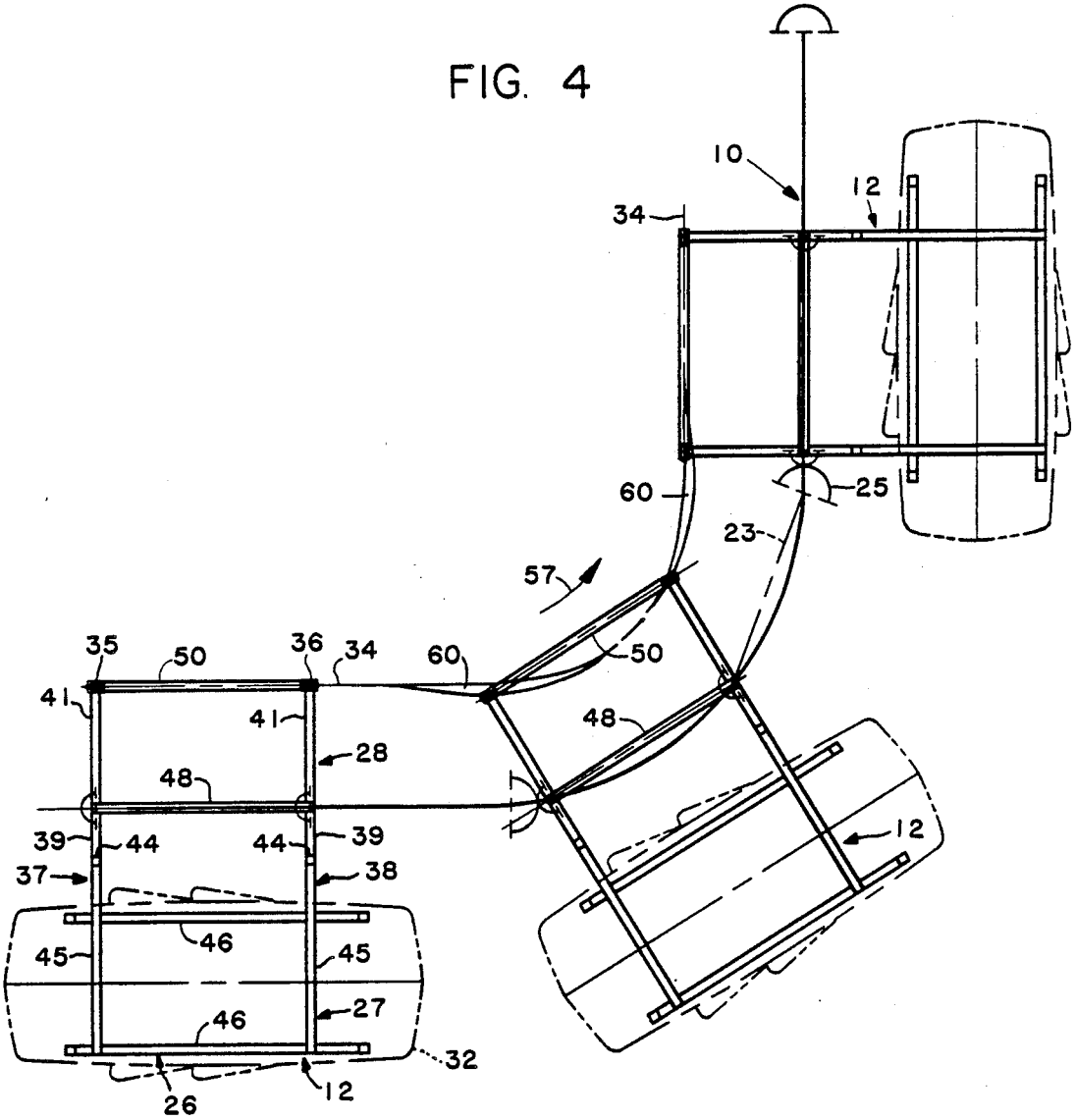
FIG. 4 is a plan view schematically illustrating a horizontal curve of the conveyor system.

FIG. 4 schematically depicts the chording effect on the stabilizing wheels 35 and 36 which results when carriers 12 travel along a horizontal curve in the conveyor track 10, and which requires that the surface 54 of the auxiliary track 34 be provided with compensating widened portions 60.

Figure 5:
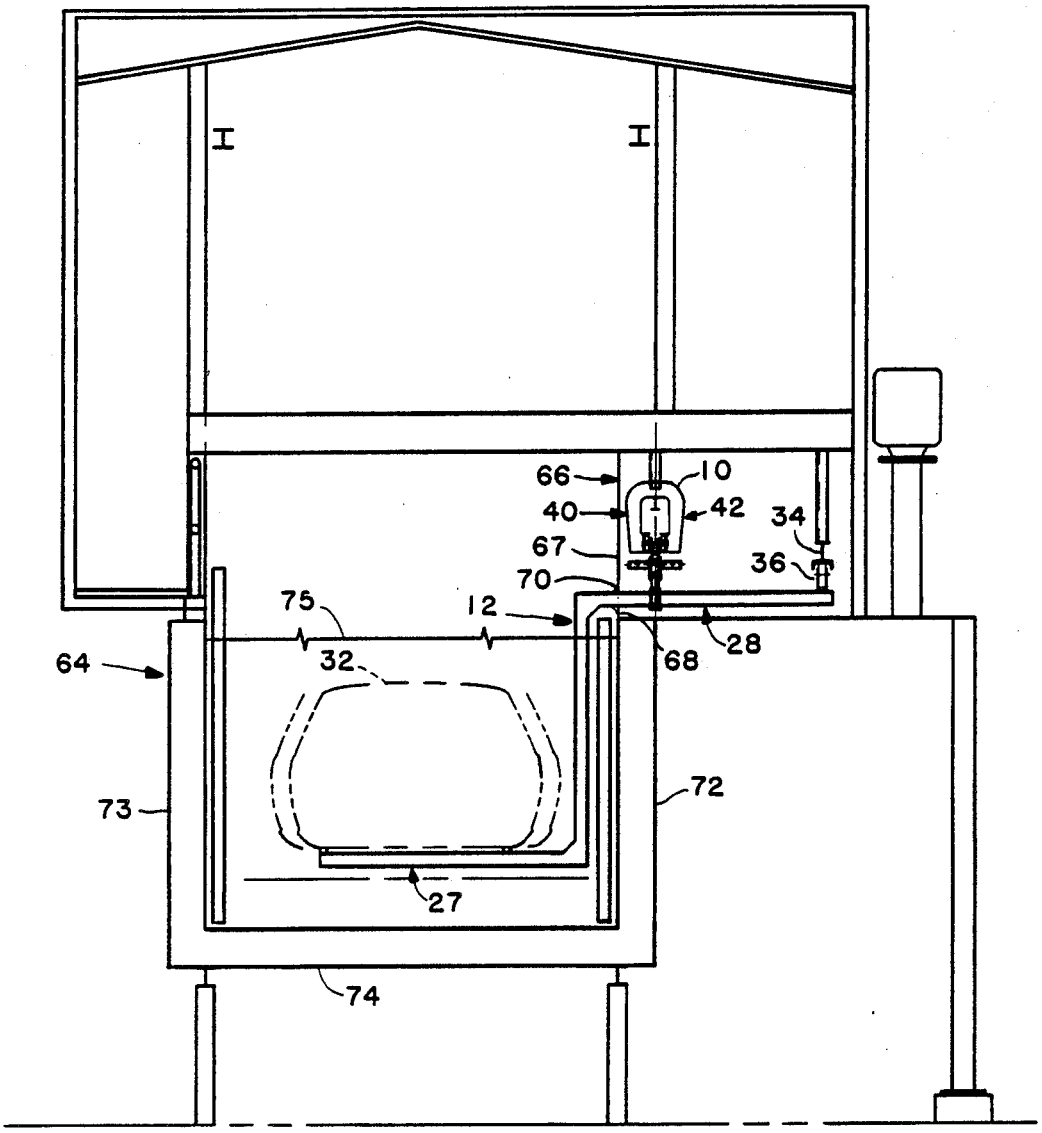
FIG. 5 is a transverse elevation illustrating an application of the conveyor system to a processing station for a processing operation on articles being conveyed.

FIG. 5 illustrates the application of the invention to a conveyor system having a processing station at which the articles being transported on the carriers 12 are subjected to one or more processing operations such as cleaning, phosphating, painting, drying, etc. all requiring some form of tank, booth, oven or other facility suited for subjecting the articles to the particular processing conditions. Common to these processing conditions is the desirability of maximum accessability of the articles to them; also common to these processing conditions is that they have some form of adverse effect on the moving trolley and chain elements of a conveyor exposed to them—for example, high temperature, corrosive atmosphere, or particle build-up. In FIG. 5, such a processing station 64 is located along the path of the conveyor track 10 on the article supporting side 40 of the conveyor track in transversely spaced relation thereto, and is provided with barrier means 66 extending along the side 40 of the track for separating it and the conveyor elements from the processing operation.

The barrier means in general comprises a wall 67 extending longitudinally parallel to the conveyor track 10 and having a longitudinally extending slot 68 through which the upper sections 39 of the transverse carrier frame members 37 and 38 project and position the article 32 supported by the article carrying means 31 within the processing station on the side of the wall 67 opposite to the conveyor track 10. Sealing means such as a flexible flap or flaps 70 may be provided along the slot 68, or desired portions thereof, to further isolate the conveyor elements from the processing conditions.

The processing station 64 shown in FIG. 5 is bounded by side walls 72 and 73 and a bottom wall 74 forming a tank type of enclosure containing a liquid 75 in which articles 32 are dipped. One of the tank sidewalls 72 extends parallel to and below the level of the conveyor track 10, the upper sections 39 of the carrier transverse frame members 37 and 38 extend laterally relative to the conveyor track 10 above the side wall 72, and through the slot 68 in the barrier wall 67 formed as an upward extension of the side wall 72. As a result, an article 32 supported from below on the downwardly and outwardly located article carrying means 31 is positioned in the station 64 for processing with minimum interference from the article supporting portion 27 of the carrier frame structure, and with separation from the conveyor chain and trolley components.

Since neither carrier structure nor conveyor structure is located above the article 32, it becomes possible to improve the processing operation itself by the more efficient mounting of electrodes for electrostatic processing, the arrangement of oven ducting for a drying process, or the placement of spray nozzles for processes such as cleaning or painting.

Figure 6:
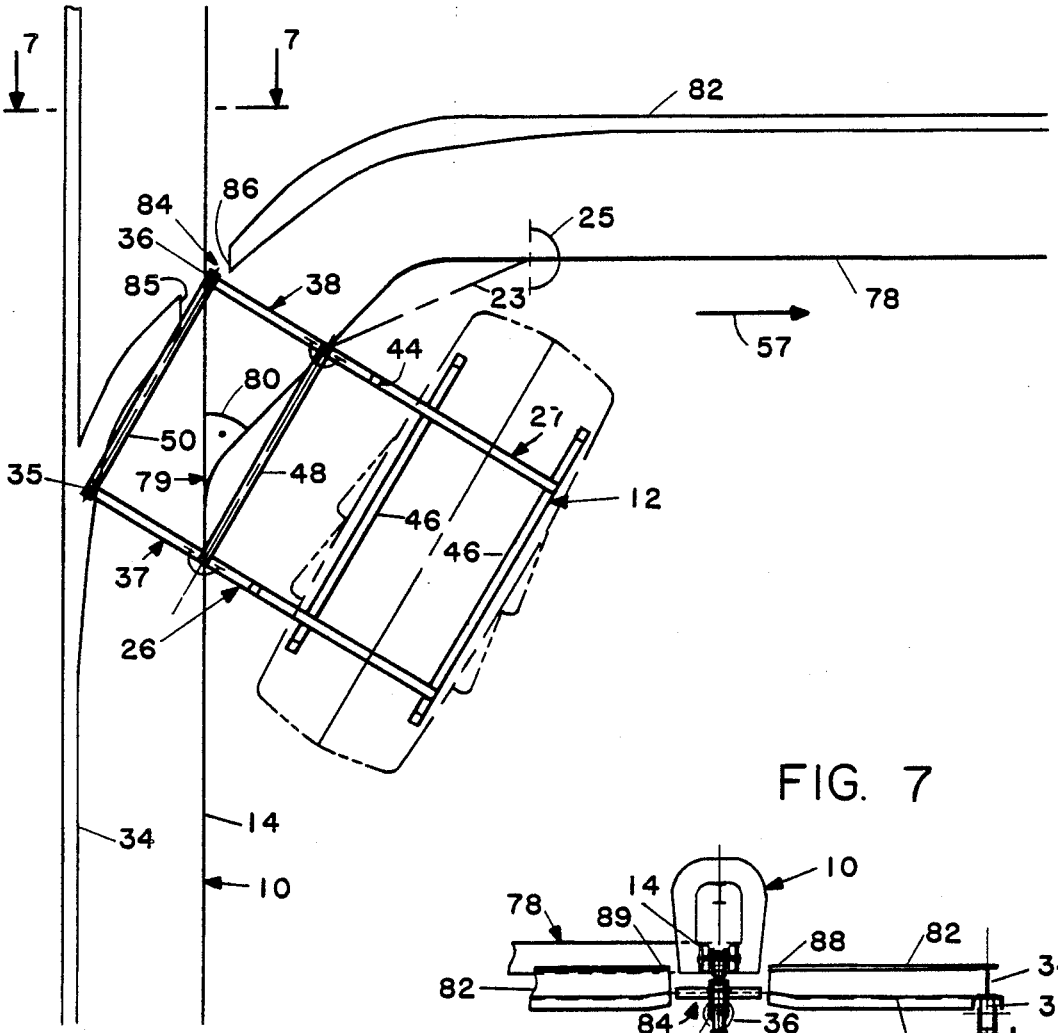
FIG. 6 is a plan view schematically illustrating a carrier transversing a junction between main and branch tracks of a conveyor system of the invention.
Figure 7:
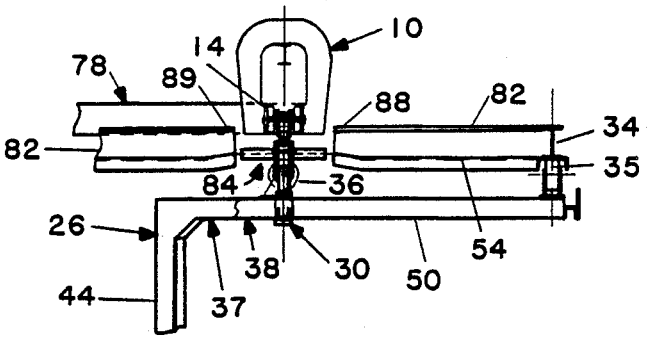
FIG. 7 is a fragmentary elevation taken as indicated by the line 7—7 of FIG. 6.

In the portion of a conveyor system of the invention shown in FIGS. 6 and 7, the power and free type of conveyor track 10 includes the main carrier track 14, a branch carrier track 78, and a junction 79 between the main and branch carrier tracks, a track switch 80 being provided at the junction 79. The auxiliary track 34 in this system becomes a main auxiliary track extending parallel to the main carrier track 14. A branch auxiliary track 82 is connected to the main auxiliary track 34 adjacent to the junction 79 and extends parallel to the branch carrier track 78, crossing the main carrier track 14. At the crossing, the branch auxiliary track 82 is provided with a gap 84 defined by spaced apart ends 85 and 86 of the crossing auxiliary track 82. As shown in FIG. 6, the length of the gap 84 is less than the longitudinal spacing between the stabilizing caster wheels 35 and 36 of the carrier 12 so that when one of the wheels 35 and 36 passes through the gap 84 the other engages the auxiliary track 34 or 82. The carrier frame structure 26 is constructed with sufficient rigidity to permit adequate stabilization thereof by one of the wheels 35 and 36. If the carrier track junction 79 were arranged so that the branch carrier track 78 diverged from the main carrier track 14 in the opposite direction, that is, to the left rather than to the right as seen in FIG. 6, the main auxiliary track 34 would then cross the branch carrier track and would be provided with the gap 84. Hence, with either type of junction, one of the main and branch auxiliary tracks 34 and 82 will cross one of the main and branch carrier tracks 14 and 78 and will be provided with the gap 84.

FIG. 7 shows that the main carrier track 14 and the crossing branch auxiliary track 82 are arranged in a relative vertical nonoverlapping relation such as to provide vertical clearance between the stabilizing wheels 35 and 36 of the carrier 12 and the main carrier track 14 which they cross, the main and branch auxiliary tracks 34 and 82 having their downwardly facing track surfaces 54 positioned below the level of the main and branch carrier tracks. Also, the carrier frame structure 26 is connected to the suspension means 30 below the level of the main and branch auxiliary tracks 34 and 82 so that the suspension means passes through the gap 84 and the length of the gap need only be sufficient to permit such passage of the suspension means 30.

Vertically flared portions 88 and 89 are provided at the spaced apart ends 85 and 86 of the branch auxiliary track 82 at the gap 84 to compensate for any upward displacement of the caster wheels 35 and 36 that may occur during their travel across the gap 84, particularly at the exit side of the gap which is defined by the track end portion 89 with carrier travel in the direction of the arrow 57 in FIG. 6.

I claim:

1. A conveyor system comprising a power and free track assembly including a carrier track, carriers supported thereby, and propelling means associated with said track assembly for moving the carriers longitudinally along said carrier track;

each carrier having a pair of trolleys spaced longitudinally of said carrier track, frame structure, and suspension means connecting said frame structure to said pair of trolleys for articulation on vertical axes spaced longitudinally a distance corresponding to the spacing between said pair of trolleys;

said frame structure having an article supporting portion disposed to one side of said carrier track and having a stabilizing portion disposed to the opposite side thereof;

an auxiliary track extending parallel to and located in transversely spaced relation with said carrier track at the said opposite side thereof, a pair of auxiliary track engaging means mounted on the stabilizing portion of said frame structure at a longitudinal spacing substantially corresponding to the longitudinal spacing between said pair of trolleys;

said carrier track including a main track, a branch track and a junction between said main and branch carrier tracks;

said auxiliary track including a main auxiliary track extending parallel to said main carrier track, a branch auxiliary track connected to said main auxiliary track adjacent to said junction and extending parallel to said branch carrier track;

one of said main and branch auxiliary tracks crossing one of said main and branch carrier tracks and having at said crossing spaced apart ends defining a gap having a length less than the longitudinal spacing between said pair of auxiliary track engaging means, said crossing one of said main and branch auxiliary tracks being arranged vertically spaced from the one of the main and branch carrier tracks crossed thereby such that vertical clearance is provided at said crossing between said auxiliary track engaging means and the crossed one of the main and branch carrier tracks.

2. A conveyor system according to claim 1 wherein said auxiliary track is provided with a downwardly facing track surface, and said pair of auxiliary track engaging means comprises a pair of caster wheels adapted to engage said track surface, each of said caster wheels having a swiveling axis located in advance of the location of engagement between the caster wheel and auxiliary track with respect to the direction of carrier movement.

3. A conveyor system according to claim 2 wherein said suspension means provides between each of said trolleys and the frame structure connected thereto relative articulation on a horizontal axis intersecting said vertical axis, the swiveling axis of each caster wheel being located in advance relative to the direction of carrier movement of the location of said intersecting vertical and horizontal axes.

4. A conveyor system according to claim 1 wherein said crossing one of said main and auxiliary tracks is provided with a vertically flared track surface engageable by said caster wheels on at least one of said spaced apart ends at an exit side of said gap.

5. A conveyor system according to claim 1 wherein said carrier track is an overhead track, said auxiliary track is provided with a downwardly facing track surface disposed vertically below said carrier track, and said suspension means is connected to said frame structure of each carrier vertically below the level of said downwardly facing track surface and is adapted to pass through said gap.

6. A conveyor system according to claim 5 wherein an article processing station is provided at a location along the path of said carrier track at said one side thereof and intransversely spaced relation thereto, said processing station being bounded by at least one sidewall extending parallel to and below the level of said carrier track at said one side thereof, and said article supporting portion of each carrier is formed by an upper section extending laterally relative to said one side of the conveyor track above said sidewall, a vertical section extending downwardly from said upper section within a boundary of said processing station defined by said sidewall, and a lower section projecting laterally from said vertical section within said processing station, and article carrying means adapted to mount an article on top of said lower section.

7. A conveyor system according to claim 6 wherein said stabilizing portion of each carrier is formed by an extension of said upper section projecting laterally to said opposite side of said conveyor track.

8. A conveyor system according to claim 6 wherein said processing station is provided with barrier means on said one side of said carrier track above said sidewall for separating said track assembly and propelling means from an area of a processing operation, said barrier means being vertically spaced from said sidewall by a slot through which said upper section of each carrier is adapted to project.

9. A conveyor system according to claim 8 wherein sealing means is provided along at least a portion of said slot.

10. A conveyor system according to claim 1 wherein said frame structure of each carrier comprises a pair of frame members spaced apart longitudinally of said conveyor track and extending transversely thereof;

each of said frame members having an article supporting section projecting laterally relative to said one side of said conveyor track;

longitudinally extending frame means connecting said article supporting sections of said pair of frame members, said article supporting sections and longitudinally extending frame means constituting the article supporting portion of said frame structure and having article carrying means attached thereto for supporting from below an article mounted on said article carrying means;

each of said transversely extending frame members having a stabilizing extension projecting laterally relative to said opposite side of said conveyor track, and a longitudinal stabilizing frame member connecting said stabilizing extensions of said pair of frame members, said stabilizing extensions and said longitudinal stabilizing frame member constituting said stabilizing portion of said frame structure.

* * * * *

UNITED STATES PATENT AND TRADEMARK OFFICE

CERTIFICATE OF CORRECTION

PATENT NO. : 5,058,508

DATED : October 22, 1991

INVENTOR(S) : Shelden M. Kavieff et al.

It is certified that error appears in the above-identified patent and that said Letters Patent is hereby corrected as shown below:

Column 1, line 36, "an" should read --and--

Column 8, line 6, "intransversely" should read --in transversely--

Signed and Sealed this

Twenty-third Day of February, 1993

*Attest:*

STEPHEN G. KUNIN

*Attesting Officer*

*Acting Commissioner of Patents and Trademarks*